US005531502A

United States Patent [19]

Berggren

[11] Patent Number: 5,531,502

[45] Date of Patent: Jul. 2, 1996

[54] COMBINATION CHAIR FOR CHILDREN

[76] Inventor: Peter G. Berggren, P.O. Box 373, Capitola, Calif. 95010

[21] Appl. No.: 354,470

[22] Filed: Dec. 12, 1994

[51] Int. Cl.[6] ..... A47C 3/029

[52] U.S. Cl. ..... 297/131; 297/153; 297/271.5; 297/423.4; 297/344.12; 297/463.1

[58] Field of Search ..... 297/118, 130–132, 297/153, 423.4, 258, 344.12, 271.5, 271.6, 272.1, 258.1, 463.1

[56] References Cited

U.S. PATENT DOCUMENTS

| | | | |
|---|---|---|---|
| 254,023 | 2/1882 | Kenna | 297/132 |
| 338,231 | 3/1886 | Kenna | 297/132 X |
| 397,851 | 2/1889 | Gifford . | |
| 604,941 | 3/1898 | Paine . | |
| 677,382 | 7/1901 | Thompson . | |
| 677,383 | 7/1901 | Thompson . | |
| 682,961 | 9/1901 | Smith . | |
| 736,180 | 8/1903 | Washburn . | |
| 775,387 | 11/1904 | Thompson . | |
| 877,204 | 1/1908 | Lepard | 297/132 |
| 896,982 | 8/1908 | Flindall | 297/423.4 |
| 993,733 | 5/1911 | Tann . | |
| 2,649,893 | 8/1953 | Spriggs | 297/130 X |
| 3,269,771 | 8/1966 | Erdos | 297/132 |
| 4,394,046 | 7/1983 | Irwin et al. | 297/132 |

FOREIGN PATENT DOCUMENTS

| | | | |
|---|---|---|---|
| 449428 | 6/1949 | Italy | 297/131 |
| 463233 | 4/1951 | Italy | 297/131 |
| 23177 | of 1895 | United Kingdom | 297/131 |

*Primary Examiner*—Milton Nelson, Jr.
*Attorney, Agent, or Firm*—Ray K. Shahani

[57] ABSTRACT

A combination chair for children which can be adjusted between a plurality of positions having two pairs of legs forming bifurcated rocker elements which in one position form legs for the chair, and in another, form rockers. The leg and rockers rotate in unison, with their relative positions maintained by intermeshing teeth of gears, until height selection locking pins, which form part of the height selection lever assembly within the gearbox assembly and are controlled by linkages, engage predetermined height selection or position holes in the legs, such that the leg and rocker elements are locked into high, intermediate, low or rocker positions.

11 Claims, 5 Drawing Sheets

COMBINATION CHAIR FOR CHILDREN

FIELD OF THE INVENTION

This invention relates to seats and chairs for children and more specifically to combination high chairs, play chairs and rocking chairs whose legs can be folded, extended or withdrawn to a plurality of positions.

DESCRIPTION OF THE PRIOR ART

Various types of combination folding high chairs and rocking chairs for a variety of uses have been described in the prior art. Among the dozens of combination folding or collapsible high chairs, rockers, strollers, playseats and cradles described, the following is a short description of a few of the most closely related.

U.S. Pat. No. 397,851 issued Feb. 12, 1889 to Gifford teaches a child's adjustable chair. The rocker elements permanently support the seat on accordion type folding cross members which can be raised and lowered as desired. The lower cross members act to prevent movement on the rockers when the chair is in the higher positions.

U.S. Pat. No. 604,941 issued May 31, 1989 to Paine, U.S. Pat. No. 677,383 issued Jul. 2, 1901 to Thompson, and U.S. Pat. No. 677,382 issued Jul. 2, 1901 to Thompson all teach a convertible chair. The legs become the rocker elements and are hinged together. A plurality of intermediate cross members connect the chair portions to the rockers.

U.S. Pat. No. 682,961 issued Sep. 17, 1901 to Smith, U.S. Pat. No. 736,180 issued Aug. 11, 1903 to Washburn and U.S. Pat. No. 775,387 issued Nov. 22, 1904 to Thompson teach a convertible high chair and rocker, a folding chair and a convertible chair, respectively. In all, two front legs curve downward and to the rear, while the two rear legs curve downward and to the front, the legs forming the rocker elements. When a lever is released, the two pairs of legs, pivoted together near the center of each leg, fold together and the seat is brought closer to the ground as the rockers support the chair.

U.S. Pat. No. 993,733, issued May 30, 1911 to Tann teaches a convertible chair. Having a standard chair seat and base portion, the legs terminate in a pair of rocker elements. The rocker elements are broken into two parts, hinged together, and a mechanical release lever allows the rocker elements to be drawn up, pivoting at the base of each front leg, and sliding through a pivoting slot at the base of the rear legs.

U.S. Pat. No. 3,269,771, class 297–132, issued Aug. 30, 1966 to Erdos teaches a triply convertible chair. This chair, like others, has two pairs of long, curved rocker elements which hinge and pivot together is a wide variety of ways.

U.S. Pat. No. 4,394,046, class 297–132, issued Jul. 19, 1983 to Irwin et al teaches a convertible rocker and high chair. A chair portion is connected to two pairs of extendable, crossing arms which in turn are connected to two pairs of rocker elements. Locking pawls and pivoting connections allow the chair portion to be raised into a high chair configuration. The chair can be lowered and the arms and rocker elements fold together as the rocker elements contact the ground.

SUMMARY OF THE INVENTION

The present invention relates to seats and chairs for children and more specifically to combination high chairs and play chairs and rocking chairs. The legs become rocker elements which are divided into two equal halves, a distinctly unique feature of the present invention. The two halves of each rocker element are joined together underneath the seat portion, mounted on a gearbox. A plurality of intermeshing gears attach to the rocker halves to operably coordinate the rocker elements so as to adjust the height of the seat and the position of the legs in unison A levered locking system assembly allows the chair to be raised and lowered into a plurality of predetermined positions. These positions range from the high chair configuration with the legs extending as vertically as possible bearing the weight of the chair and its inhabitant upon the tips of the leg and rocker elements to any one of a number of intermediate positions for allowing the child to play, sleep or other, to a lowest position where the chair is supported by the two arcuate rocker elements. A locking height selection lever, acting in a spring loaded cam fashion with linkages, controls the action of pins which extend through the gearbox housing into holes in the inside faces of the leg and rocker elements, thus locking the teeth of the intermeshed gears into predetermined positions. This child-proof locking height selection lever also provides a safety mechanism which ensures that the chair cannot slip between positions unless intentionally manually operated by an adult. Another feature of a preferred embodiment of the present invention makes the leg and rocker elements themselves sprung elements, such that when the chair is in a lowered position springs act to fold the legs back together into a higher, unsprung position. This feature adds ease to the operation of the combination chair in that it is relatively simple to force the legs out into a lower or rocker position but when the pins release the legs, the legs will tend to bring the chair up assisting the person adjusting the chair overcome the force of gravity. Additionally in the event the height adjustment pins are withdrawn inadvertently while the chair is in a high position, the sprung legs will not allow the chair to collapse downward causing potential personal injury or property damage.

A combination chair for children having a plurality of configurations including a high chair position, a play chair position and a rocker position is disclosed. The combination chair comprises a seat portion suitably designed for children and two pairs of legs rotatably coupled to the seat portion. Each of the legs has an upper portion, the upper portion being rotatably coupled to the seat portion, an end tip opposite the upper portion, and an arcuate rocker portion lying between the upper portion and the end tip, the arcuate rocker portion operative for providing a rocking motion to the chair in the rocker position. In a preferred embodiment the pairs of legs are cooperatively rotatably coupled to the seat portion, in one embodiment utilizing a plurality of gear elements attached to the legs for cooperatively rotatably coupling the legs to the seat portion. The invention further comprises a means for rotatably positioning the pairs of legs into predetermined positions whereby the height of the chair can be selected, in one embodiment the means for rotatably positioning the pairs of legs into predetermined positions comprising a plurality of locking pins, the locking pins mounted in the seat portion, a plurality of locking pin receiving holes in a plurality of the legs, wherein the precise positions of the plurality of locking pin receiving holes in each of the legs cooperatively rotatably coupled to the seat portion and coordinated with each other such that when a predetermined height of the chair is selected the plurality of locking pins extend to engage the locking pin receiving holes in the legs and maintain the chair at the selected, predetermined height, a height selection lever, a height selection lever axle having a first end and a second end, the lever attached to the axle at the first end, and a plurality of linkages, the linkages eccentrically mounted on the axle and attached to the locking pins, wherein the height selection lever can turn the axle and retract the locking pins to change the height of the chair. In one embodiment, the invention comprises a locking pin biasing means, wherein the plurality of locking pins are biased to extend outwardly to engage with the plurality of locking pin receiving holes. In one embodiment the biasing means comprises a locking pin spring. In one embodiment the invention further comprises a leg biasing means, and in one embodiment the leg biasing means comprises a compression spring. In one embodiment the leg biasing means comprises a coil spring. In one embodiment, the invention further comprises accessories which include a flat, tray section suitable for serving the child, the flat tray section removably attached to the seat portion in an operable position The accessories could also include a foot support, the foot support removably attached to the seat portion in an operable position. In one embodiment, the invention further comprises a central arcuate element forming, in conjunction with the central arcuate rocker portions of the legs, contiguous rocker elements, thereby providing smooth rocking motion for the chair in the rocker configuration.

Numerous other advantages and features of the present invention will become readily apparent from the following detailed description of the invention and the embodiments thereof, from the claims and from the accompanying drawings in which the details of the invention are fully and completely disclosed as a part of this specification.

DETAILED DESCRIPTION OF THE PREFERRED EMBODIMENTS

Figure 1:
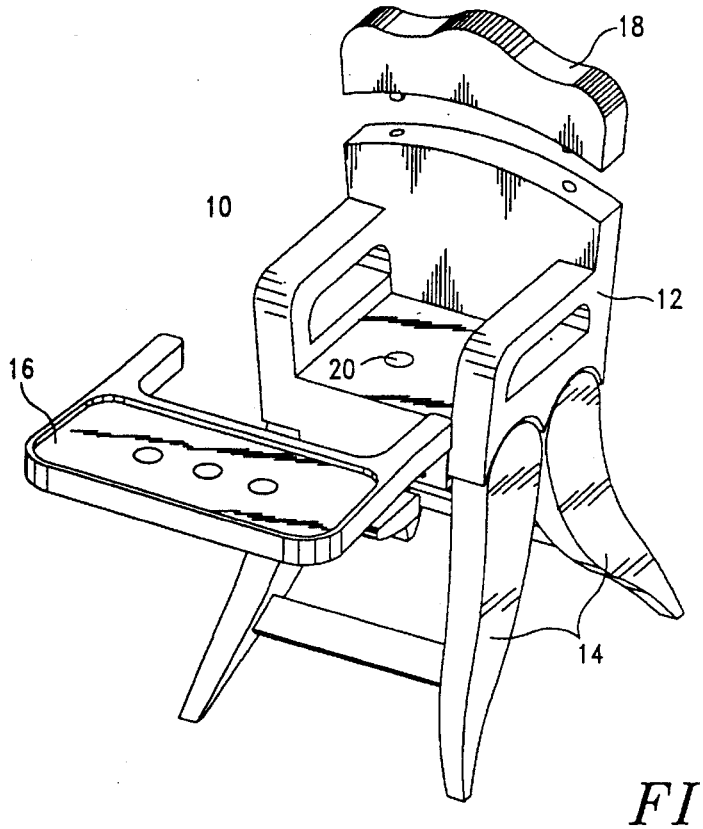
FIG. 1 is a front upper perspective view of a preferred embodiment of the present invention.

FIG. 1 is a front upper perspective view of a preferred embodiment of the present invention. The combination chair for children 10 has a seat portion 12 and two pairs of legs 14. Optional accessories include a tray 16 and a headrest 18. An optional central hole 20 can be used to insert a play animal head such as a horse head or a dinosaur head, etc.

Figure 2:
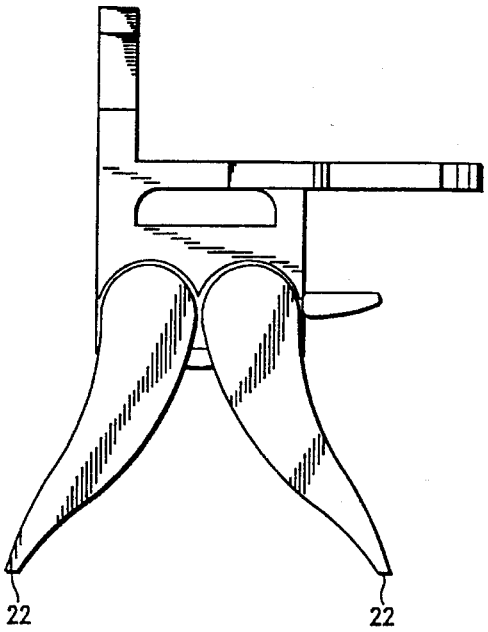
FIG. 2 is a side view of a preferred embodiment of the present invention in the high chair position.

FIG. 2 is a side view of a preferred embodiment of the present invention in the high chair position. In this position, the child can be fed or otherwise entertained. In this position, the chair is similar to any other high chair and a multiplicity of embodiments, each having slight differences with respect to the shape of the legs, the shape of the seat portion, etc., would be readily apparent to one of ordinary skill in the art. Support tips 22 at the end of each leg support the weight of the loaded or unloaded chair.

Figure 3:
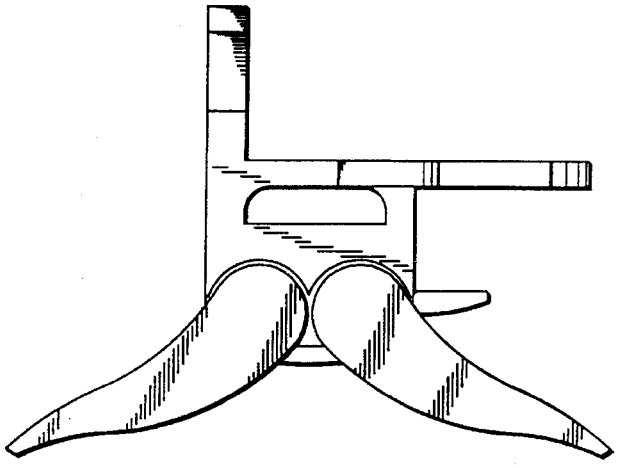
FIG. 3 is a side view of a preferred embodiment of the present invention in the play chair position.

FIG. 3 is a side view of a preferred embodiment of the present invention in the play chair position. With legs shaped as shown in the drawing, in this position, the supporting tips are still in contact with the surface the chair is resting upon and thus are still useful for supporting the chair.

Figure 4:
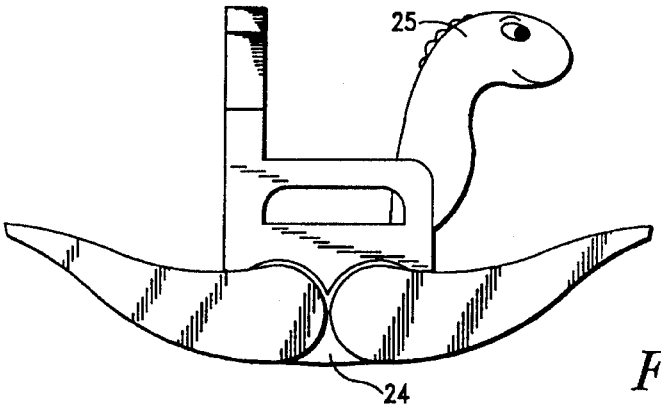
FIG. 4 is a side view of a preferred embodiment of the present invention in the rocker position.

FIG. 4 is a side view of a preferred embodiment of the present invention in the rocker position. In this position, a central arcuate member 24 is necessary for providing an essentially continuous arc shaped rocking surface for the chair to rock smoothly upon. This member must possess a predetermined radius of curvature corresponding to that formed by the leg and rocker elements in the rocker position. In the embodiment shown, the arcuate member conveniently covers the base of the gearbox thereby allowing the gearbox to be covered and thus safer and more convenient for users. This arcuate member could also consist of two flat, arcuate elements on either side of the gearbox itself and need not necessarily cover the bottom of the gearbox. In this configuration, the profile view of FIG. 4 would be the same.

Figure 5:
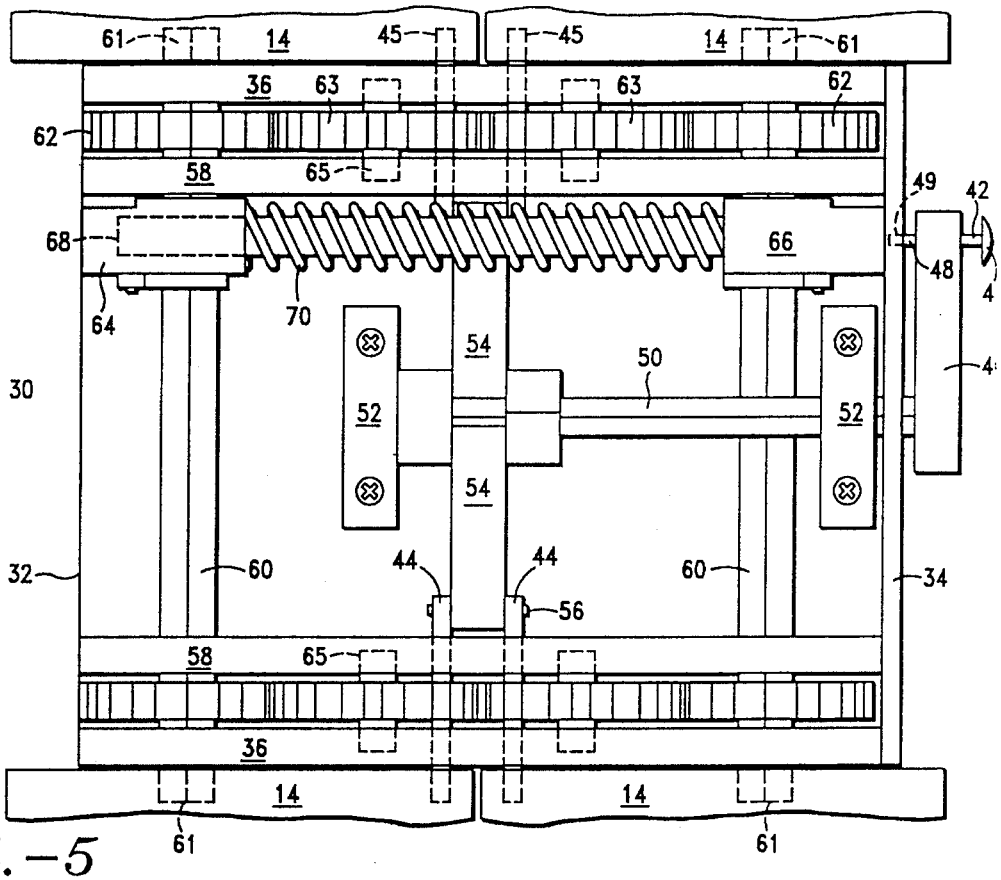
FIG. 5 is a bottom view of the legs and gearbox assembly of a preferred embodiment of the present invention.

FIG. 5 is a bottom view of the legs and gearbox assembly of a preferred embodiment of the present invention. The gearbox 30 has a front section 32, a back section 34, and two side sections 36. It will be understood that the gearbox might or might not have a separate and distinct upper or lower section. This is because the chair could be constructed in such as manner so as to allow the seat portion to be removable or fixed to the legs and gearbox assembly and a separate and distinct upper section may or may not be necessary. However, in a preferred embodiment, the bottom of the gearbox would be covered by the central arcuate member for safety, ease of cleaning, or for other reasons. The height selection lever 40 with the associated height selection lever safety pin 42 is used to withdraw height selection locking pins 44 from any of a plurality of locking pin receiving holes 45 located in predetermined positions in the pairs of legs. The height selection lever safety pin could have a head portion 46 and a shaft portion 48. The tip of the shaft portion would be inserted into a safety pin hole 49 in the back section of the gearbox. In this manner, the height selection lever would have less chance of being moved inadvertently or by small children. This height selection lever safety pin could itself be spring loaded such that the pin could be withdrawn or retracted by the head portion and would return to an extended position automatically, or the shaft portion and the mounting hole in the height selection lever could be correspondingly threaded such that the shaft could be retracted and replaced into the hole on the back section of the gearbox by turning the head portion with a screwing action.

The height selection lever is attached to a height selection lever axle 50 which passes through the back section of the gearbox is held in place by bearing blocks 52. These elements assist in keeping the height selection lever axle in place while allowing the axle to rotate. The height selection lever axle is coupled to a plurality of linkages 54 which in turn are coupled to the height selection lever locking pins. Both couplings described in the immediately preceding sentence could consist of a coupling pin 56 or some other coupling means which would be readily apparent to one skilled in the art. Gear cover plates 58 are optional but depending upon the construction details, might be useful for supporting or maintaining the gears in a coplanar relationship or for safety or for ease of cleaning, etc. It will become readily apparent to those skilled in the art that a large number of variations on this type of height selection assembly or method are possible. These include the use of additional levers, buttons, electronic or magnetic couplings or electronically activated mechanical couplings and other means for rotatably positioning the pairs of legs into predetermined positions whereby the height of the chair can be selected.

A plurality of leg axles 60 extend through the gearbox and attach to each pair of legs. Attached to each leg axle are primary gears 62 and secondary gears 63. These gear have intermeshing teeth. The secondary gears could be attached to the gear box at points 65. It will become readily apparent that a plurality of gears can be used. By increasing the number of gears, the smoothness and ease of moving the legs between the high chair position and the rocker position and any or all points in between will be enhanced. It will become readily apparent that these gears are important for maintaining the plurality of pairs of legs in relative operating positions. Due to the intermeshing teeth of the gears, the pairs of legs will operate in unison and open and close together, thus facilitating the selection of the desired height or position of the chair. This gear assembly can be considered but one means for providing cooperatively rotatably legs coupled to the seat portion of the chair.

Attached to the leg axles are a first piston sleeve 64 and a second piston sleeve 66. Attached to the latter piston sleeve is a piston 68 which extends from within the second piston sleeve and slides through the first piston sleeve. A stiff compression spring 70 is held in place by the piston and the piston sleeves. This compression spring is useful for producing a sprung condition in the legs when the chair is placed into the rocker position. This sprung condition is useful for selecting desired heights of the chair by counteracting the effect of gravity and assisting the operator in bringing the chair up from the low, rocker position into the high chair position.

Figure 6:
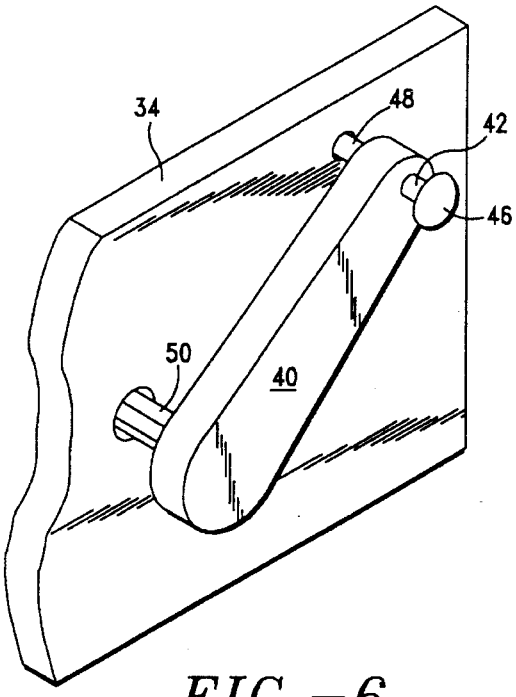
FIG. 6 is a partial perspective view of the height selection lever assembly of a preferred embodiment of the present invention in a predetermined position.

FIG. 6 is a partial perspective view of the height selection lever assembly of a preferred embodiment of the present invention in a predetermined position. It will be clear to one skilled in the art that the height selection lever is secured in its position by the height selection lever safety pin.

Figure 7:
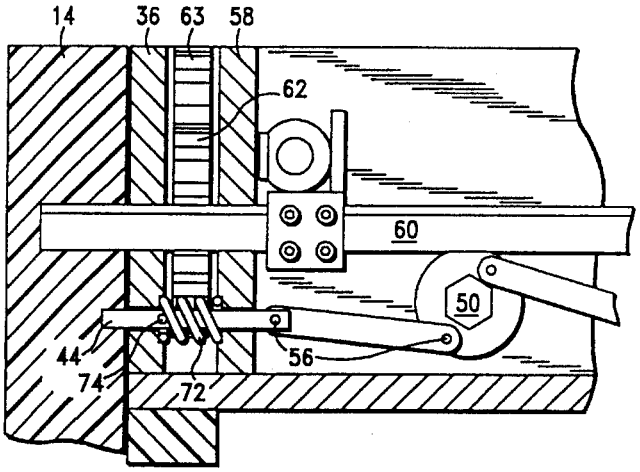
FIG. 7 is a side view of the height selection locking assembly of a preferred embodiment of the present invention in an unsprung position.

FIG. 7 is a side view of the height selection locking assembly of a preferred embodiment of the present invention in an unsprung position. The height selection lever locking pins, coupled to the linkages by the coupling pins are controlled by the axial position of the height selection lever axle. A height selection locking pin spring 72 is held in place over the height selection locking pins between the side section of the gearbox and the gear cover plate of the gearbox. The spring could be fixedly attached to the pin or a stub 74 could be used extending from the pin to hook the spring. It will be understood that essentially one half of the height selection lever assembly is shown in the drawing and the same structure would exist for any or each of the other locking pins.

Figure 8:
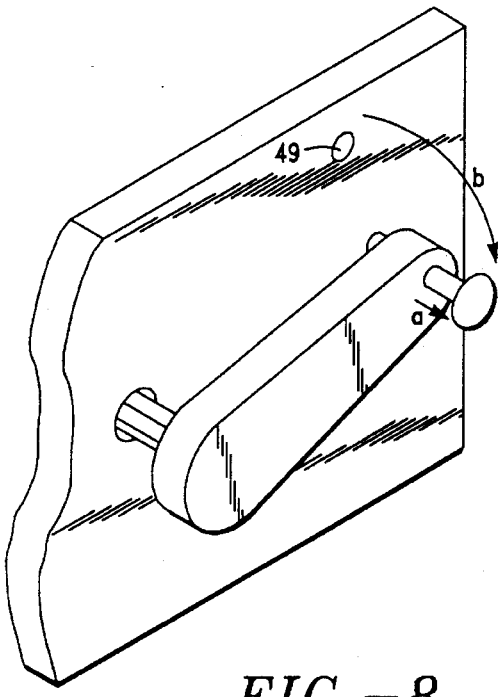
FIG. 8 is a partial perspective view of the height selection lever assembly of a preferred embodiment of the present invention in a select mode.

FIG. 8 is a partial perspective view of the height selection lever assembly of a preferred embodiment of the present invention in a select mode. It will be clear to one skilled in the art that once the height selection lever safety pin is withdrawn from the safety pin hole in the back section of the gearbox, as indicated by arrow a, the height selection lever can be rotated downwards as indicated by arrow b.

Figure 10:
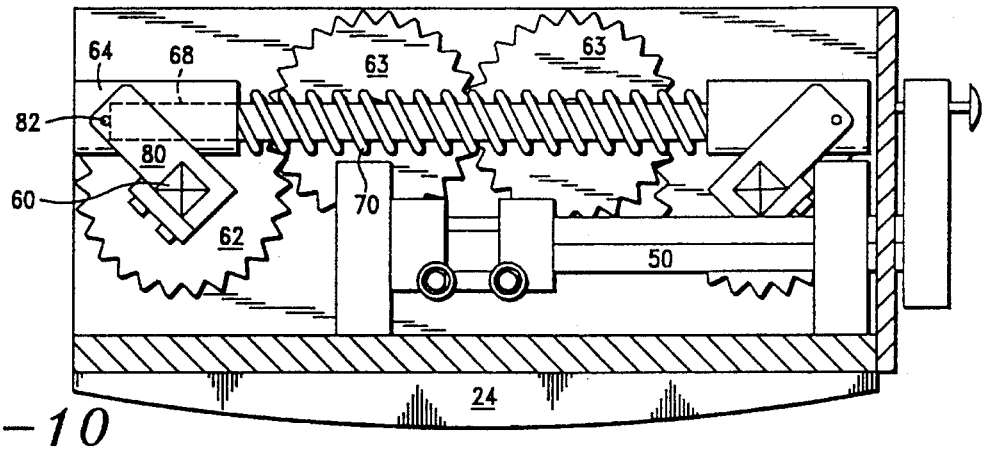
FIG. 10 is a side view of the leg and rocker elements coordinating gear assembly of a preferred embodiment of the present invention in an unsprung position.
Figure 9:
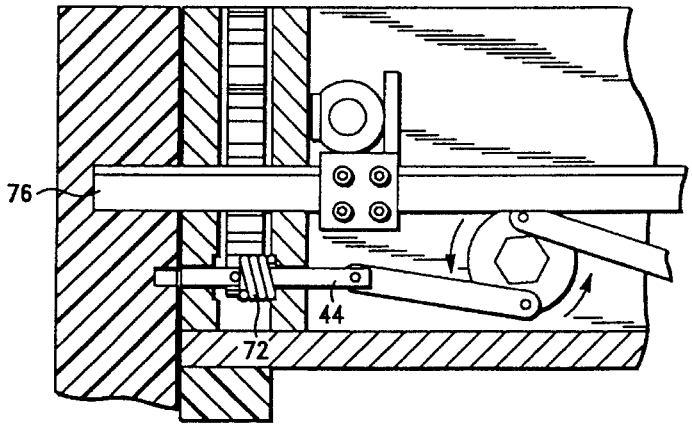
FIG. 9 is a side view of the height selection locking assembly of a preferred embodiment of the present invention in a sprung position.

FIG. 9 is a side view of the height selection locking assembly of a preferred embodiment of the present invention in a sprung position. This drawing corresponds to the action shown in the immediately preceding drawing. Once the height selection lever axle is rotated, as shown by the arrows, the linkages act to withdraw the height selection locking pins from the height selection holes in the legs. This rotation will cause the height selection locking pin spring to compress, as shown, and act to force the pins outward into the locking pin receiving holes. It will be readily apparent to one skilled in the art that a plurality of holes located at various radial positions about the point of attachment 76 of the leg axle to the leg can be utilized. In this manner, a chair with almost any number of intermediate positions can be had. The high chair position and the rocker position are but the extreme positions of the chair, i.e. the highest position and the lowest, and a number of intermediate positions can be selected. It will be readily apparent to one skilled in the art that providing this height selection lever assembly with holes in the legs to select predetermined height positions for the chair is but one design embodiment of the present invention, and a multiplicity of other structures or methods will be possible to effect similar raising and lowering action of the chair into predetermined positions. These would include variations on the mechanical assembly, use of electronic, pneumatic, hydraulic, or magnetic locks, switches, actuators, or controllers, or other means for FIG. 10 is a side view of the leg and rocker elements coordinating gear assembly of a preferred embodiment of the present invention in an unsprung position. The teeth of the primary gears are intermeshed with the teeth of the secondary gears, as described earlier. Attached to the leg axles are brackets 80 which rotate with the legs and are coupled to the first and second piston sleeves. This coupling can be comprised of a bracket coupling pin 82 or can be some other coupling means which will allow relative motion between the rotating brackets and the piston sleeves.

Figure 11:
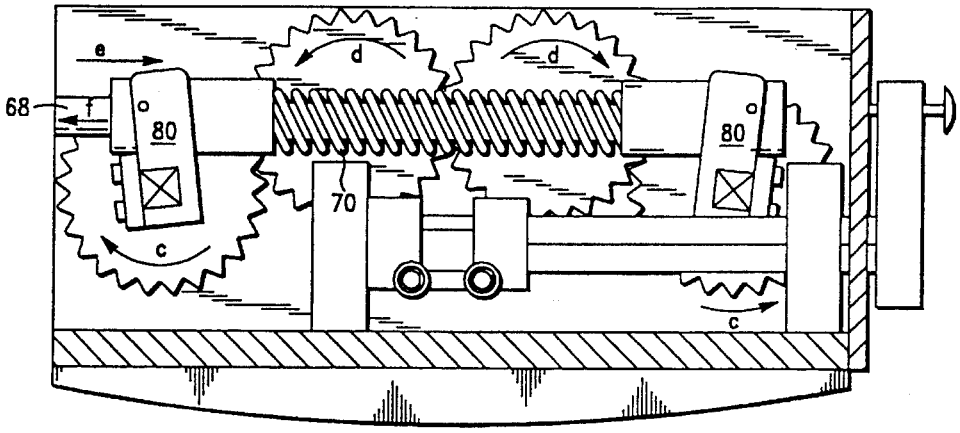
FIG. 11 is a side view of the leg and rocker elements coordinating gear assembly of a preferred embodiment of the present invention in a sprung position.

FIG. 11 is a side view of the leg and rocker elements coordinating gear assembly of a preferred embodiment of the present invention in a sprung position. As the legs and primary gear plate are rotated as indicated by arrow c such that the legs move from a relatively high position to a relatively low position, the secondary gear plates rotate as indicated by arrows d and the piston sleeves coupled to the rotating ears move inward as indicated by arrows e. The effect is to compress the spring and drive the piston outward as indicated by arrow f. Thus, a sprung piston will tend to rotate the legs back toward the unsprung, high position.

Figure 12:
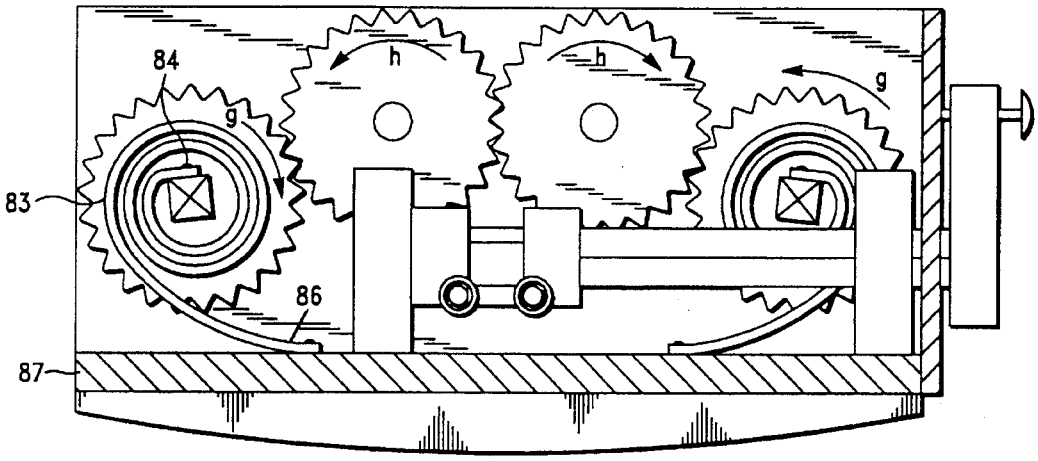
FIG. 12 is a side view of the leg and rocker elements coordinating gear assembly of another preferred embodiment of the present invention.

FIG. 12 is a side view of the leg and rocker elements coordinating gear assembly of another preferred embodiment of the present invention. As the legs and primary gear plate are rotated as indicated by arrow g such that the legs move from a relatively high position to a relatively low position, the secondary gear plates rotate as indicated by arrows h. A coil spring 83 is attached at one end 84 to the leg axle and at the other end 86 to the bottom section 87 of the gearbox. This embodiment, though different than that shown in the two immediately preceding drawings, functions similarly. As the legs are rotated outward, the coil spring becomes compressed and under tension. This tension will tend to rotate the legs back into the normally unsprung position. Although this embodiment is shown in one drawing, it will be understood that there will be an unsprung condition position as well as a plurality of sprung condition positions. It will be apparent to one skilled in the art that the two embodiments shown in FIGS. 10–12 are demonstrative of only two means for biasing the legs. Furthermore, in these embodiments the legs are biased in the downwardly rotated position. Other configurations, including those with the legs of the chair biased into a normally low rocker configuration, and other means for carrying these out, including tension springs, magnets, electronically controlled or operated, pneumatic or hydraulic assemblies are possible.

Figure 13:
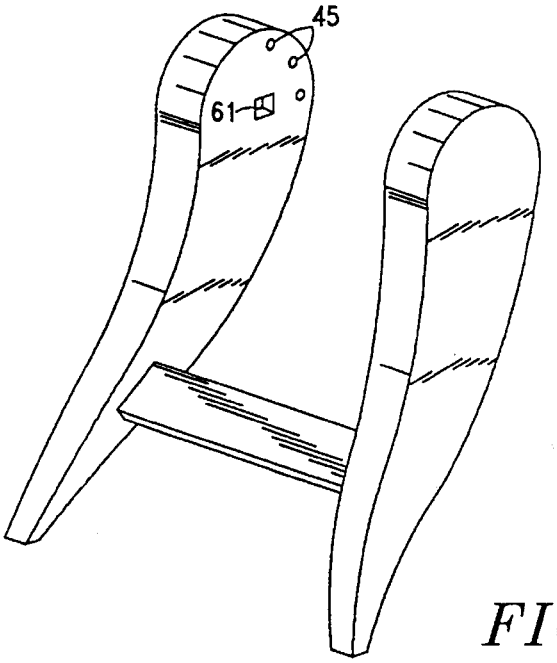
FIG. 13 is a perspective view of the inside of one leg of a preferred embodiment of the present invention.

FIG. 13 is a perspective view of the inside of one leg of a preferred embodiment of the present invention. This view shows in particular the plurality of locking pin receiving holes. It will be apparent to one skilled in the art that various modifications in the number and positions of these holes will be possible.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted to specific environments and operative requirements without departing from those principles. The appended claims are intended to cover and embrace any and all such modifications, with the limits only of the true spirit and scope of the invention.

I claim:

1. A combination chair for children having a plurality of configurations including a high chair position, a play chair position and a rocker position, the combination chair comprising:

a seat portion suitably designed for children;

two pairs of legs rotatably coupled to the seat portion, each of the legs having:

an upper portion, the upper portion being rotatably coupled to the seat portion;

an end tip opposite the upper portion; and an arcuate rocker portion lying between the upper portion and the end tip, the arcuate rocker portion operative for providing a rocking motion to the chair in the rocker position; and a means for rotatably positioning the pairs of legs into predetermined positions whereby the height of the chair can be selected, the means comprising:

a plurality of locking pins, the locking pins mounted in the seat portion;

a plurality of locking pin receiving holes in a plurality of the legs, wherein the precise positions of the plurality of locking pin receiving holes in each of the legs are coordinated with each other such that when a predetermined height of the chair is selected the plurality of locking pins extend to engage the locking pin receiving holes in the legs and maintain the chair at the selected, predetermined height;

a height selection lever;

a height selection lever axle having a first end and a second end, the lever attached to the axle at the first end; and a plurality of linkages, the linkages eccentrically mounted on the axle and attached to the locking pins, wherein the height selection lever can turn the axle and retract the locking pins to change the height of the chair.

2. The chair of claim 1 wherein the pairs of legs are cooperatively rotatably coupled to the seat portion.

3. The chair of claim 1 further comprising a plurality of gear elements attached to the legs for cooperatively rotatably coupling the legs to the seat portion.

4. The chair of claim 1 further comprising a central arcuate element forming, in conjunction with the central arcuate rocker portions of the legs, contiguous rocker elements, thereby providing smooth rocking motion for the chair in the rocker configuration.

5. The chair of claim 1 further comprising a locking pin biasing means, wherein the plurality of locking pins are biased to extend outwardly to engage with the plurality of locking pin receiving holes.

6. The chair of claim 5 wherein the biasing means comprises a locking pin spring.

7. The chair of claim 1 wherein the combination children's chair further comprises accessories which include a flat, tray section suitable for serving the child, the flat tray section removably attached to the seat portion in an operable position.

8. The chair of claim 7 wherein the accessories include a foot support, the foot support removably attached to the seat portion in an operable position.

9. The chair of claim 1 further comprising leg biasing means.

10. The chair of claim 9 wherein the leg biasing means comprises a compression spring.

11. The chair of claim 9 wherein the leg biasing means comprises a coil spring.

* * * * *